US011004458B2

(12) United States Patent
Choo et al.

(10) Patent No.: US 11,004,458 B2
(45) **Date of Patent: *May 11, 2021**

(54) CODING MODE DETERMINATION METHOD AND APPARATUS, AUDIO ENCODING METHOD AND APPARATUS, AND AUDIO DECODING METHOD AND APPARATUS

(71) Applicant: SAMSUNG ELECTRONICS CO., LTD., Suwon-si (KR)

(72) Inventors: Ki-hyun Choo, Seoul (KR); Anton Victorovich Porov, Saint-Petersburg (RU); Konstantin Sergeevich Osipov, Saint-Petersburg (RU); Nam-suk Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/593,041

(22) Filed: Oct. 4, 2019

(65) Prior Publication Data

US 2020/0035252 A1 Jan. 30, 2020

Related U.S. Application Data

(63) Continuation of application No. 16/039,110, filed on Jul. 18, 2018, now Pat. No. 10,468,046, which is a (Continued)

(51) Int. Cl.
*G10L 19/20* (2013.01)
*G10L 19/12* (2013.01)
(Continued)

(52) U.S. Cl.
CPC ..... *G10L 19/12* (2013.01); *G10L 19/22* (2013.01); *G10L 19/00* (2013.01); *G10L 19/20* (2013.01)

(58) Field of Classification Search
CPC ..... G10L 19/20; G10L 19/22
See application file for complete search history.

(56) References Cited

U.S. PATENT DOCUMENTS 6,360,199 B1 3/2002 Yokoyama
6,658,383 B2 12/2003 Koishida et al.
(Continued)

FOREIGN PATENT DOCUMENTS

CN 1954364 A 4/2007
CN 101025918 A 8/2007
(Continued)

OTHER PUBLICATIONS

Communication dated Dec. 12, 2018 by the Intellectual Property Office of India in counterpart Indian Patent Application No. 1345/MUMNP/2015.
(Continued)

*Primary Examiner* — Feng-Tzer Tzeng
(74) *Attorney, Agent, or Firm* — Sughrue Mion, PLLC

(57) ABSTRACT

Provided are a method and an apparatus for determining an encoding mode for improving the quality of a reconstructed audio signal. A method of determining an encoding mode includes determining one from among a plurality of encoding modes including a first encoding mode and a second encoding mode as an initial encoding mode in correspondence to characteristics of an audio signal, and if there is an error in the determination of the initial encoding mode, generating a modified encoding mode by modifying the initial encoding mode to a third encoding mode.

5 Claims, 7 Drawing Sheets

Related U.S. Application Data continuation of application No. 14/079,090, filed on Nov. 13, 2013, now abandoned.

(60) Provisional application No. 61/725,694, filed on Nov. 13, 2012.

(51) Int. Cl.
*G10L 19/22* (2013.01)
*G10L 19/00* (2013.01)

(56) References Cited

U.S. PATENT DOCUMENTS

| | | | | |
|---|---|---|---|---|
| 6,691,084 | B2 | 2/2004 | Manjunath | |
| 6,704,711 | B2 | 3/2004 | Gustafsson | |
| 6,799,161 | B2 | 9/2004 | Yokoyama | |
| 7,203,638 | B2 | 4/2007 | Jelinek | |
| 7,496,505 | B2 | 2/2009 | Manjunath et al. | |
| 7,739,120 | B2 | 6/2010 | Makinen | |
| 7,860,709 | B2 | 12/2010 | Makinen | |
| 7,962,835 | B2 | 6/2011 | Sung et al. | |
| 7,991,621 | B2 | 8/2011 | Oh et al. | |
| 8,392,179 | B2 | 3/2013 | Yu | |
| 8,571,858 | B2 * | 10/2013 | Fuchs | G10L 19/22 704/231 |
| 9,214,161 | B2 | 12/2015 | Tsujino et al. | |
| 9,280,974 | B2 | 3/2016 | Kikuiri et al. | |
| 2003/0004711 | A1 | 1/2003 | Koishida | |
| 2003/0009325 | A1 | 1/2003 | Kirchherr | |
| 2003/0101050 | A1 * | 5/2003 | Khalil | G10L 19/22 704/216 |
| 2005/0096898 | A1 | 5/2005 | Singhal | |
| 2005/0192798 | A1 | 9/2005 | Vainio | |
| 2005/0256701 | A1 | 11/2005 | Makinen | |
| 2007/0162924 | A1 * | 7/2007 | Radhakrishnan | G06K 9/00718 725/18 |
| 2007/0179783 | A1 | 8/2007 | Manjunath et al. | |
| 2007/0244695 | A1 | 10/2007 | Manjunath et al. | |
| 2008/0147414 | A1 | 6/2008 | Son et al. | |
| 2008/0312914 | A1 | 12/2008 | Rajendran | |
| 2010/0268542 | A1 | 10/2010 | Kim et al. | |
| 2011/0010168 | A1 | 1/2011 | Yu | |
| 2011/0016077 | A1 | 1/2011 | Vasilache et al. | |
| 2011/0035213 | A1 * | 2/2011 | Malenovsky | G10L 25/78 704/208 |
| 2012/0069899 | A1 | 3/2012 | Mehrotra et al. | |
| 2012/0253797 | A1 | 10/2012 | Geiger et al. | |
| 2013/0159005 | A1 | 6/2013 | Kikuiri et al. | |
| 2013/0185063 | A1 * | 7/2013 | Atti | G10L 19/20 704/219 |
| 2015/0154967 | A1 | 6/2015 | Grill et al. | |

FOREIGN PATENT DOCUMENTS

| | | | |
|---|---|---|---|
| CN | 101091108 | A | 12/2007 |
| CN | 101178899 | A | 5/2008 |
| CN | 101197130 | A | 6/2008 |
| CN | 101197135 | A | 6/2008 |
| CN | 101256772 | A | 9/2008 |
| CN | 101393741 | A | 3/2009 |
| CN | 101399039 | A | 4/2009 |
| CN | 101751920 | A | 6/2010 |
| CN | 102113051 | A | 6/2011 |
| CN | 102237085 | A | 11/2011 |
| CN | 102341851 | A | 2/2012 |
| CN | 102385863 | A | 3/2012 |
| CN | 102446504 | A | 5/2012 |
| CN | 103098125 | A | 5/2013 |
| EP | 2 096 629 | A1 | 9/2009 |
| EP | 2144230 | A1 | 1/2010 |
| EP | 2605240 | A1 | 6/2013 |
| JP | 2000-010591 | A | 1/2000 |
| JP | 2012-42534 | A | 3/2012 |
| JP | 2012-042534 | A | 3/2012 |
| KR | 10-2008-0075050 | A | 8/2008 |
| KR | 10-2010-0134576 | A | 12/2010 |
| RU | 2428748 | C2 | 9/2011 |
| WO | 2010003564 | A1 | 1/2010 |
| WO | 2010/040522 | A2 | 4/2010 |
| WO | 2012-020828 | A1 | 2/2012 |
| WO | 2014010175 | | 1/2014 |

OTHER PUBLICATIONS

Communication dated Aug. 7, 2018, from the Japanese Patent Office in counterpart application No. 2017-127285.

Bai et al., "Feature Analysis and Extraction for Audio Automatic Classification", Journal of Chinese Mini-Micro Computer Systems, vol. 26, No. 11, Nov. 30, 2011, 6 pages total.

Chen et al., "Speech Music Classification Based on MLER and GMM", Audio Engineering, vol. 35, No. 10, Oct. 31, 2011, 4 pages total.

Communication dated Apr. 19, 2017 by the State Intellectual property Office of P.R. China in counterpart Chinese Patent Application No. 201380070268.6.

Communication dated Sep. 13, 2016, issued by the Japanese Patent Office in counterpart Japanese application No. 2015-542948.

TSG-SA WG4, "3GPP TS 26.290 version 2.0.0 Extended Adaptive Multi-Rate—Wideband codec; Transcoding functions (Release 6)", TSGS#25 (04)0639 Meeting #25, Palm Springs, CA, USA; Sep. 2004, 3GPP TS 26.290 v.2.0.0, ,Technical Specification, 3rd Generation Partnership Project; Technical Specificaton Group Service and System Aspects; Audio codec processing functions; Extended AMR Wideband codec; Transcoding functions (Release 6), XP050202966, total 86 pages.

Communication dated Jun. 1, 2016, issued by the Australian Patent Office in counterpart Australian Application No. 2013345615.

Communication dated Jun. 17, 2016, issued by the European Patent Office in counterpart European Application No. 13854639.5.

Communication dated Jul. 19, 2016, issued by the European Patent Office in counterpart European Application No. 13854639.5.

Communication dated Jul. 27, 2016, issued by the Russian Patent Office in counterpart Russian application No. 2015122128.

International Search Report (PCT/ISA/210), dated Feb. 27, 2014, issued by the International Searching Authority in counterpart International Patent Application No. PCT/KR2013/010310.

Written Opinion (PCT/ISA/237), dated Feb. 27, 2014, issued by the International Searching Authority in counterpart International Patent Application No. PCT/KR2013/010310.

Wang, "Phonetic Segmentation for Low Rate Speech Coding," Chapter 21, Kluwer Academic Publisher, 1991.

Kikuiri, et al., "MPEG Unified Speech and Audio Coding Enabling Efficient Coding of both Speech and Music," NTT DOCOMO Technical Journal, vol. 13, No. 3, 2011. https://www.nttdocomo.co.jp/english/binary/pdf/corporate/technology/rd/techincal_journal/bn/vol13_3/vol13_3_017en.pdf.

Communication dated Feb. 9, 2021 by the Korean Intellectual Property Office in counterpart Korean Patent Application No. 10-2015-7012623.

Communication dated Mar. 26, 2021, from the China National Intellectual Property Administration in Application No. 201711424971.9.

* cited by examiner

CODING MODE DETERMINATION METHOD AND APPARATUS, AUDIO ENCODING METHOD AND APPARATUS, AND AUDIO DECODING METHOD AND APPARATUS

CROSS-REFERENCE TO RELATED PATENT APPLICATIONS

This application is a continuation application of U.S. application Ser. No. 16/039,110, filed on Jul. 18, 2018, which is a continuation application of U.S. application Ser. No. 14/079,090, filed on Nov. 13, 2013, which claims the benefit of U.S. Provisional Application No. 61/725,694, filed on Nov. 13, 2012, in the United States Patent and Trademark Office, the disclosures of which are incorporated herein by reference in their entireties.

BACKGROUND

1. Field

Apparatuses and methods consistent with exemplary embodiments relate to audio encoding and decoding, and more particularly, to a method and an apparatus for determining an encoding mode for improving the quality of a reconstructed audio signal, by determining an encoding mode appropriate to characteristics of an audio signal and preventing frequent encoding mode switching, a method and an apparatus for encoding an audio signal, and a method and an apparatus for decoding an audio signal.

2. Description of the Related Art

It is widely known that it is efficient to encode a music signal in the frequency domain and it is efficient to encode a speech signal in the time domain. Therefore, various techniques for classifying the type of an audio signal, in which the music signal and the speech signal are mixed, and determining an encoding mode in correspondence to the classified type have been suggested.

However, due to frequency encoding mode switching, not only delays occur, but also decoded sound quality is deteriorated. Furthermore, since there is no technique for modifying a primarily determined encoding mode, if an error occurs during determination of an encoding mode, the quality of a reconstructed audio signal is deteriorated.

SUMMARY

Aspects of one or more exemplary embodiments provide a method and an apparatus for determining an encoding mode for improving the quality of a reconstructed audio signal, by determining an encoding mode appropriate to characteristics of an audio signal, a method and an apparatus for encoding an audio signal, and a method and an apparatus for decoding an audio signal.

Aspects of one or more exemplary embodiments provide a method and an apparatus for determining an encoding mode appropriate to characteristics of an audio signal and reducing delays due to frequent encoding mode switching, a method and an apparatus for encoding an audio signal, and a method and an apparatus for decoding an audio signal.

Additional aspects will be set forth in part in the description which follows and, in part, will be apparent from the description, or may be learned by practice of the presented embodiments.

According to an aspect of one or more exemplary embodiments, there is a method of determining an encoding mode, the method including determining one from among a plurality of encoding modes including a first encoding mode and a second encoding mode as an initial encoding mode in correspondence to characteristics of an audio signal, and if there is an error in the determination of the initial encoding mode, generating a modified encoding mode by modifying the initial encoding mode to a third encoding mode.

According to an aspect of one or more exemplary embodiments, there is a method of encoding an audio signal, the method including determining one from among a plurality of encoding modes including a first encoding mode and a second encoding mode as an initial encoding mode in correspondence to characteristics of an audio signal, if there is an error in the determination of the initial encoding mode, generating a modified encoding mode by modifying the initial encoding mode to a third encoding mode, and performing different encoding processes on the audio signal based on either the initial encoding mode or the modified encoding mode.

According to an aspect of one or more exemplary embodiments, there is a method of decoding an audio signal, the method including parsing a bitstream comprising one of an initial encoding mode obtained by determining one from among a plurality of encoding modes including a first encoding mode and a second encoding mode in correspondence to characteristics of an audio signal and a third encoding mode modified from the initial encoding mode if there is an error in the determination of the initial encoding mode, and performing different decoding processes on the bitstream based on either the initial encoding mode or the third encoding mode.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
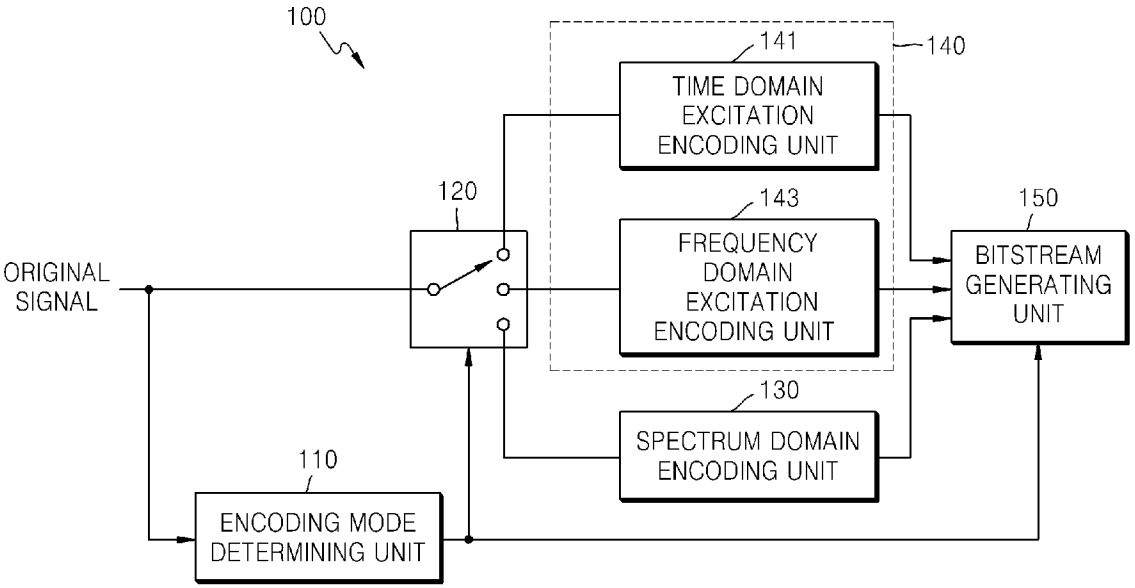
FIG. 1 is a block diagram illustrating a configuration of an audio encoding apparatus according to an exemplary embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description.

Terms such as "connected" and "linked" may be used to indicate a directly connected or linked state, but it shall be understood that another component may be interposed therebetween.

Terms such as "first" and "second" may be used to describe various components, but the components shall not be limited to the terms. The terms may be used only to distinguish one component from another component.

The units described in exemplary embodiments are independently illustrated to indicate different characteristic functions, and it does not mean that each unit is formed of one separate hardware or software component. Each unit is illustrated for the convenience of explanation, and a plurality of units may form one unit, and one unit may be divided into a plurality of units.

FIG. 1 is a block diagram illustrating a configuration of an audio encoding apparatus 100 according to an exemplary embodiment.

The audio encoding apparatus 100 shown in FIG. 1 may include an encoding mode determining unit 110, a switching unit 120, a spectrum domain encoding unit 130, a linear prediction domain encoding unit 140, and a bitstream generating unit 150. The linear prediction domain encoding unit 140 may include a time domain excitation encoding unit 141 and a frequency domain excitation encoding unit 143, where the linear prediction domain encoding unit 140 may be embodied as at least one of the two excitation encoding units 141 and 143. Unless it is necessary to be embodied as a separate hardware, the above-stated components may be integrated into at least one module and may be implemented as at least one processor (not shown). Here, the term of an audio signal may refer to a music signal, a speech signal, or a mixed signal thereof.

Referring to FIG. 1, the encoding mode determining unit 110 may analyze characteristics of an audio signal to classify the type of the audio signal, and determine an encoding mode in correspondence to a result of the classification. The determining of the encoding mode may be performed in units of superframes, frames, or bands. Alternatively, the determining of the encoding mode may be performed in units of a plurality of superframe groups, a plurality of frame groups, or a plurality of band groups. Here, examples of the encoding modes may include a spectrum domain and a time domain or a linear prediction domain, but are not limited thereto. If performance and processing speed of a processor are sufficient and delays due to encoding mode switching may be resolved, encoding modes may be subdivided, and encoding schemes may also be subdivided in correspondence to the encoding mode. According to an exemplary embodiment, the encoding mode determining unit 110 may determine an initial encoding mode of an audio signal as one of a spectrum domain encoding mode and a time domain encoding mode. According to another exemplary embodiment, the encoding mode determining unit 110 may determine an initial encoding mode of an audio signal as one of a spectrum domain encoding mode, a time domain excitation encoding mode and a frequency domain excitation encoding mode. If the spectrum domain encoding mode is determined as the initial encoding mode, the encoding mode determining unit 110 may modify the initial encoding mode to one of the spectrum domain encoding mode and the frequency domain excitation encoding mode. If the time domain encoding mode, that is, the time domain excitation encoding mode is determined as the initial encoding mode, the encoding mode determining unit 110 may modify the initial encoding mode to one of the time domain excitation encoding mode and the frequency domain excitation encoding mode. If the time domain excitation encoding mode is determined as the initial encoding mode, the determination of the final encoding mode may be selectively performed. In other words, the initial encoding mode, that is, the time domain excitation encoding mode may be maintained. The encoding mode determining unit 110 may determine encoding modes of a plurality of frames corresponding to a hangover length, and may determine the final encoding mode for a current frame. According to an exemplary embodiment, if the initial encoding mode or a modified encoding mode of a current frame is identical to encoding modes of a plurality of previous frames, e.g., 7 previous frames, the corresponding initial encoding mode or modified encoding mode may be determined as the final encoding mode of the current frame. Meanwhile, if the initial encoding mode or a modified encoding mode of a current frame is not identical to encoding modes of a plurality of previous frames, e.g., 7 previous frames, the encoding mode determining unit 110 may determine the encoding mode of the frame just before the current frame as the final encoding mode of the current frame.

As described above, by determining the final encoding mode of a current frame based on modification of the initial encoding mode and encoding modes of frames corresponding to a hangover length, an encoding mode adaptive to characteristics of an audio signal may be selected while preventing frequent encoding mode switching between frames.

Generally, the time domain encoding, that is, the time domain excitation encoding may be efficient for a speech signal, the spectrum domain encoding may be efficient for a music signal, and the frequency domain excitation encoding may be efficient for a vocal and/or harmonic signal.

In correspondence to an encoding mode determined by the encoding mode determining unit 110, the switching unit 120 may provide an audio signal to either the spectrum domain encoding unit 130 or the linear prediction domain encoding unit 140. If the linear prediction domain encoding unit 140 is embodied as the time domain excitation encoding unit 141, the switching unit 120 may include total two branches. If the linear prediction domain encoding unit 140 is embodied as the time domain excitation encoding unit 141 and the frequency domain excitation encoding unit 143, the switching unit 120 may have total 3 branches.

The spectrum domain encoding unit 130 may encode an audio signal in the spectrum domain. The spectrum domain may refer to the frequency domain or a transform domain. Examples of coding methods applicable to the spectrum domain encoding unit 130 may include an advance audio coding (AAC), or a combination of a modified discrete cosine transform (MDCT) and a factorial pulse coding (FPC), but are not limited thereto. In detail, other quantizing techniques and entropy coding techniques may be used instead of the FPC. It may be efficient to encode a music signal in the spectrum domain encoding unit 130.

The linear prediction domain encoding unit 140 may encode an audio signal in a linear prediction domain. The linear prediction domain may refer to an excitation domain or a time domain. The linear prediction domain encoding unit 140 may be embodied as the time domain excitation encoding unit 141 or may be embodied to include the time domain excitation encoding unit 141 and the frequency domain excitation encoding unit 143. Examples of coding methods applicable to the time domain excitation encoding unit 141 may include code excited linear prediction (CELP) or an algebraic CELP (ACELP), but are not limited thereto. Examples of coding methods applicable to the frequency domain excitation encoding unit 143 may include general signal coding (GSC) or transform coded excitation (TCX), are not limited thereto. It may be efficient to encode a speech signal in the time domain excitation encoding unit 141, whereas it may be efficient to encode a vocal and/or harmonic signal in the frequency domain excitation encoding unit 143.

The bitstream generating unit 150 may generate a bitstream to include the encoding mode provided by the encoding mode determining unit 110, a result of encoding provided by the spectrum domain encoding unit 130, and a result of encoding provided by the linear prediction domain encoding unit 140.

Figure 2:
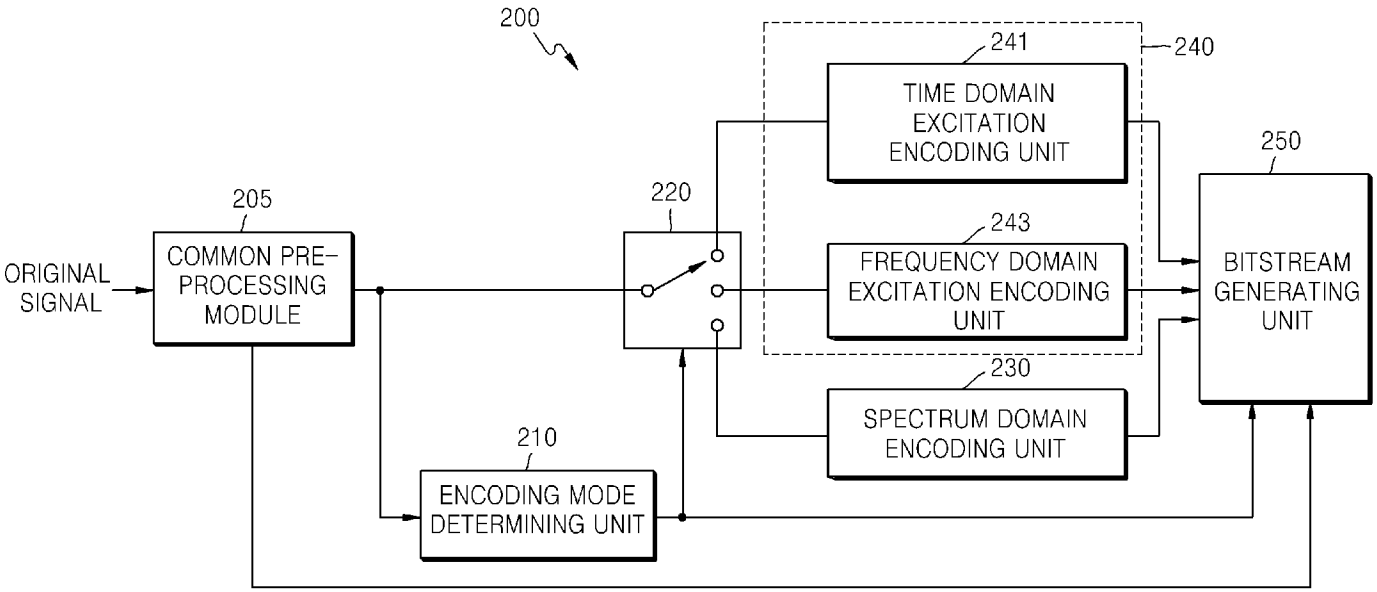
FIG. 2 is a block diagram illustrating a configuration of an audio encoding apparatus according to another exemplary embodiment.

FIG. 2 is a block diagram illustrating a configuration of an audio encoding apparatus 200 according to another exemplary embodiment.

The audio encoding apparatus 200 shown in FIG. 2 may include a common pre-processing module 205, an encoding mode determining unit 210, a switching unit 220, a spectrum domain encoding unit 230, a linear prediction domain encoding unit 240, and a bitstream generating unit 250. Here, the linear prediction domain encoding unit 240 may include a time domain excitation encoding unit 241 and a frequency domain excitation encoding unit 243, and the linear prediction domain encoding unit 240 may be embodied as either the time domain excitation encoding unit 241 or the frequency domain excitation encoding unit 243. Compared to the audio encoding apparatus 100 shown in FIG. 1, the audio encoding apparatus 200 may further include the common pre-processing module 205, and thus descriptions of components identical to those of the audio encoding apparatus 100 will be omitted.

Referring to FIG. 2, the common pre-processing module 205 may perform joint stereo processing, surround processing, and/or bandwidth extension processing. The joint stereo processing, the surround processing, and the bandwidth extension processing may be identical to those employed by a specific standard, e.g., the MPEG standard, but are not limited thereto. Output of the common pre-processing module 205 may be in a mono channel, a stereo channel, or multi channels. According to the number of channels of an signal output by the common pre-processing module 205, the switching unit 220 may include at least one switch. For example, if the common pre-processing module 205 outputs a signal of two or more channels, that is, a stereo channel or a multi-channel, switches corresponding to the respective channels may be arranged. For example, the first channel of a stereo signal may be a speech channel, and the second channel of the stereo signal may be a music channel. In this case, an audio signal may be simultaneously provided to the two switches. Additional information generated by the common pre-processing module 205 may be provided to the bitstream generating unit 250 and included in a bitstream. The additional information may be necessary for performing the joint stereo processing, the surround processing, and/or the bandwidth extension processing in a decoding end and may include spatial parameters, envelope information, energy information, etc. However, there may be various additional information based on processing techniques applied thereto.

According to an exemplary embodiment, at the common pre-processing module 205, the bandwidth extension processing may be differently performed based on encoding domains. The audio signal in a core band may be processed by using the time domain excitation encoding mode or the frequency domain excitation encoding mode, whereas an audio signal in a bandwidth extended band may be processed in the time domain. The bandwidth extension processing in the time domain may include a plurality of modes including a voiced mode or an unvoiced mode. Alternatively, an audio signal in the core band may be processed by using the spectrum domain encoding mode, whereas an audio signal in the bandwidth extended band may be processed in the frequency domain. The bandwidth extension processing in the frequency domain may include a plurality of modes including a transient mode, a normal mode, or a harmonic mode. To perform bandwidth extension processing in different domains, an encoding mode determined by the encoding mode determining unit 110 may be provided to the common pre-processing module 205 as a signaling information. According to an exemplary embodiment, the last portion of the core band and the beginning portion of the bandwidth extended band may overlap each other to some extent. Location and size of the overlapped portions may be set in advance.

Figure 3:
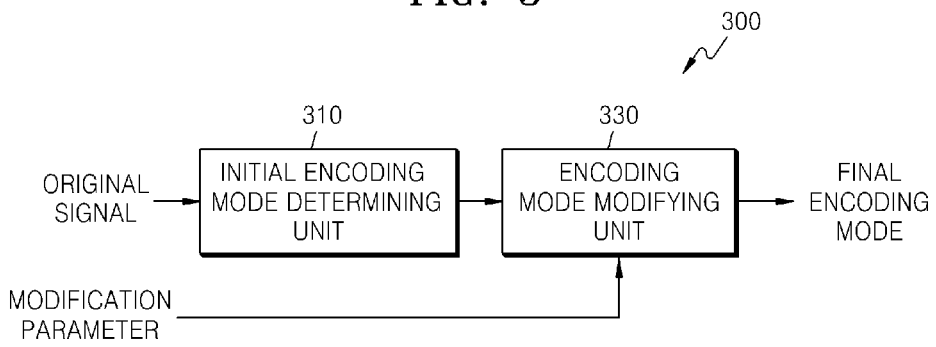
FIG. 3 is a block diagram illustrating a configuration of an encoding mode determining unit according to an exemplary embodiment.

FIG. 3 is a block diagram illustrating a configuration of an encoding mode determining unit 300 according to an exemplary embodiment.

The encoding mode determining unit 300 shown in FIG. 3 may include an initial encoding mode determining unit 310 and an encoding mode modifying unit 330.

Referring to FIG. 3, the initial encoding mode determining unit 310 may determine whether an audio signal is a music signal or a speech signal by using feature parameters extracted from the audio signal. If the audio signal is determined as a speech signal, linear prediction domain encoding may be suitable. Meanwhile, if the audio signal is determined as a music signal, spectrum domain encoding may be suitable. The initial encoding mode determining unit 310 may determine the type of the audio signal indicating whether spectrum domain encoding, time domain excitation encoding, or frequency domain excitation encoding is suitable for the audio signal by using feature parameters extracted from the audio signal. A corresponding encoding mode may be determined based on the type of the audio signal. If a switching unit (120 of FIG. 1) has two branches, an encoding mode may be expressed in 1-bit. If the switching unit (120 of FIG. 1) has three branches, an encoding mode may be expressed in 2-bits. The initial encoding mode determining unit 310 may determine whether an audio signal is a music signal or a speech signal by using any of various techniques known in the art. Examples thereof may include FD/LPD classification or ACELP/TCX classification disclosed in an encoder part of the USAC standard and ACELP/TCX classification used in the AMR standards, but are not limited thereto. In other words, the initial encoding mode may be determined by using any of various methods other than the method according to embodiments described herein.

The encoding mode modifying unit 330 may determine a modified encoding mode by modifying the initial encoding mode determined by the initial encoding mode determining unit 310 by using modification parameters. According to an exemplary embodiment, if the spectrum domain encoding mode is determined as the initial encoding mode, the initial encoding mode may be modified to the frequency domain excitation encoding mode based on modification parameters. If the time domain encoding mode is determined as the initial encoding mode, the initial encoding mode may be modified to the frequency domain excitation encoding mode based on modification parameters. In other words, it is determined whether there is an error in determination of the initial encoding mode by using modification parameters. If it is determined that there is no error in the determination of the initial encoding mode, the initial encoding mode may be maintained. On the contrary, if it is determined that there is an error in the determination of the initial encoding mode, the initial encoding mode may be modified. The modification of the initial encoding mode may be obtained from the spectrum domain encoding mode to the frequency domain excitation encoding mode and from the time domain excitation encoding mode to frequency domain excitation encoding mode.

Meanwhile, the initial encoding mode or the modified encoding mode may be a temporary encoding mode for a current frame, where the temporary encoding mode for the current frame may be compared to encoding modes for previous frames within a preset hangover length and the final encoding mode for the current frame may be determined.

Figure 4:
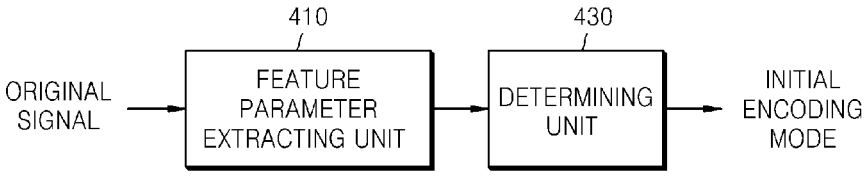
FIG. 4 is a block diagram illustrating a configuration of an initial encoding mode determining unit according to an exemplary embodiment.

FIG. 4 is a block diagram illustrating a configuration of an initial encoding mode determining unit 400 according to an exemplary embodiment.

The initial encoding mode determining unit 400 shown in FIG. 4 may include a feature parameter extracting unit 410 and a determining unit 430.

Referring to FIG. 4, the feature parameter extracting unit 410 may extract feature parameters necessary for determining an encoding mode from an audio signal. Examples of the extracted feature parameters include at least one or two from among a pitch parameter, a voicing parameter, a correlation parameter, and a linear prediction error, but are not limited thereto. Detailed descriptions of individual parameters will be given below.

First, a first feature parameter $F_1$ relates to a pitch parameter, where a behavior of pitch may be determined by using N pitch values detected in a current frame and at least one previous frame. To prevent an effect from a random deviation or a wrong pitch value, M pitch values significantly different from the average of the N pitch values may be removed. Here, N and M may be values obtained via experiments or simulations in advance. Furthermore, N may be set in advance, and a difference between a pitch value to be removed and the average of the N pitch values may be determined via experiments or simulations in advance. The first feature parameter $F_1$ may be expressed as shown in Equation 1 below by using the average $m_{p'}$ and the variance $\sigma_{p'}$ with respect to (N−M) pitch values.

$$F_1 = \frac{\sigma_{p'}}{m_{p'}} \quad \text{[Equation 1]}$$

A second feature parameter $F_2$ also relates to a pitch parameter and may indicate reliability of a pitch value detected in a current frame. The second feature parameter $F_2$ may be expressed as shown in Equation 2 bellow by using variances $\sigma_{SF1}$ and $\sigma_{SF2}$ of pitch values respectively detected in two sub-frames $SF_1$ and $SF_2$ of a current frame.

$$F_2 = \frac{\mathrm{cov}(SF_1, SF_2)}{\sigma_{SF_1}\sigma_{SF_2}} \quad \text{[Equation 2]}$$

Here, $\mathrm{cov}(SF_1,SF_2)$ denotes the covariance between the sub-frames $SF_1$ and $SF_2$. In other words, the second feature parameter $F_2$ indicates correlation between two sub-frames as a pitch distance. According to an exemplary embodiment, a current frame may include two or more sub-frames, and Equation 2 may be modified based on the number of sub-frames.

A third feature parameter $F_3$ may be expressed as shown in Equation 3 below based on a voicing parameter Voicing and a correlation parameter Corr.

$$F_3 = \sqrt{\sum \frac{[\mathrm{Voicing} - \mathrm{Corr}]^2}{N}} \quad \text{[Equation 3]}$$

Here, the voicing parameter Voicing relates to vocal features of sound and may be obtained any of various methods known in the art, whereas the correlation parameter Corr may be obtained by summing correlations between frames for each band.

A fourth feature parameter $F_4$ relates to a linear prediction error $E_{LPC}$ and may be expressed as shown in Equation 4 below.

$$F_4 = \frac{\sqrt{(E_{LPCi} - M(E_{LPC}))^2}}{N} \quad \text{[Equation 4]}$$

Here, $M(E_{LPC})$ denotes the average of N linear prediction errors.

The determining unit 430 may determine the type of an audio signal by using at least one feature parameter provided by the feature parameter extracting unit 410 and may determine the initial encoding mode based on the determined type. The determining unit 430 may employ soft decision mechanism, where at least one mixture may be formed per feature parameter. According to an exemplary embodiment, the type of an audio signal may be determined by using the Gaussian mixture model (GMM) based on mixture probabilities. A probability f(x) regarding one mixture may be calculated according to Equation 5 below.

$$f(x) = \frac{1}{\sqrt{(2\pi)^N \det(C^{-1})}} e^{-0.5(x-m)^T C^{-1}(x-m)} \quad \text{[Equation 5]}$$

$$x = (x_1, \ldots, x_N)$$

$$m = (|x_1|, \ldots, |x_N|)$$

Here, x denotes an input vector of a feature parameter, m denotes a mixture, and c denotes a covariance matrix.

The determining unit 430 may calculate a music probability Pm and a speech probability Ps by using Equation 6 below.

$$P_m = \sum_{i \subset M} p_i,\ P_s = \sum_{i \subset S} p_i \quad \text{[Equation 6]}$$

Here, the music probability Pm may be calculated by adding probabilities Pi of M mixtures related to feature parameters superior for music determination, whereas the speech probability Ps may be calculated by adding probabilities Pi of S mixtures related to feature parameters superior for speech determination.

Meanwhile, for improved precision, the music probability Pm and the speech probability Ps may be calculated according to Equation 7 below.

$$P_m = \sum_{i \subset M} p_i(1 - p_i^{err}) + \sum_{i \subset S} p_i(p_i^{err}) \quad \text{[Equation 7]}$$

$$P_s = \sum_{i \subset S} p_i(1 - p_i^{err}) + \sum_{i \subset M} p_i(p_i^{err})$$

Here, $P_i^{err}$ denotes error probability of each mixture. The error probability may be obtained by classifying training data including clean speech signals and clean music signals using each of mixtures and counting the number of wrong classifications.

Next, the probability $P^M$ that all frames include music signals only and the speech probability $P^S$ that all frames include speech signals only with respect to a plurality of frames as many as a constant hangover length may be calculated according to Equation 8 below. The hangover length may be set to 8, but is not limited thereto. Eight frames may include a current frame and 7 previous frames.

$$p^M = \frac{\prod_{i=0}^{-7} p_m^{(i)}}{\prod_{i=0}^{-7} p_m^{(i)} + \prod_{i=0}^{-7} p_s^{(i)}} \quad \text{[Equation 8]}$$

$$p^S = \frac{\prod_{i=0}^{-7} p_s^{(i)}}{\prod_{i=0}^{-7} p_m^{(i)} + \prod_{i=0}^{-7} p_s^{(i)}}$$

Next, a plurality of conditions sets $\{D_i^M\}$ and $\{D_i^S\}$ may be calculated by using the music probability Pm or the speech probability Ps obtained using Equation 5 or Equation 6. Detailed descriptions thereof will be given below with reference to FIG. 6. Here, it may be set such that each condition has a value 1 for music and has a value 0 for speech.

Figure 6:
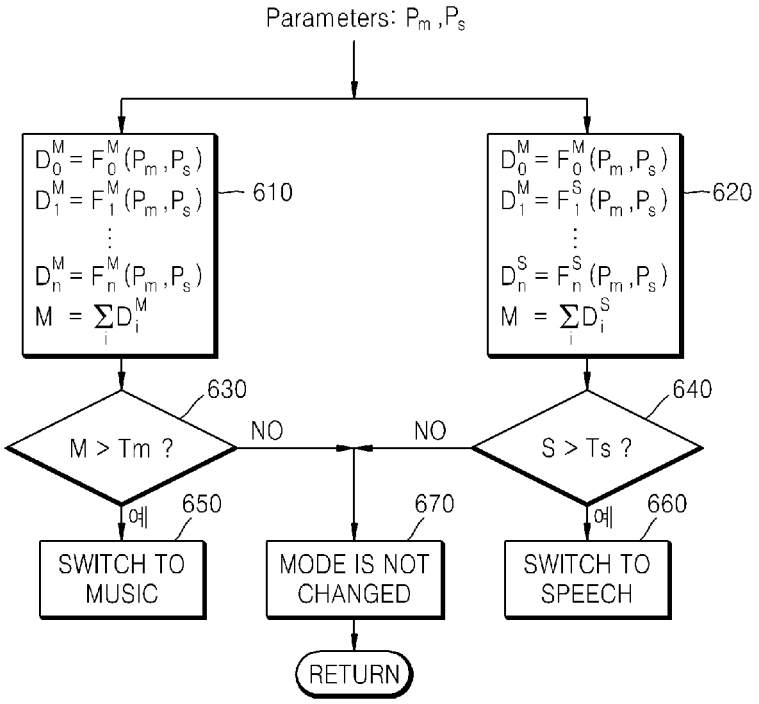
FIG. 6 is a diagram illustrating an adaptive switching method between a linear prediction domain encoding and a spectrum domain according to an exemplary embodiment.

Referring to FIG. 6, in an operation 610 and an operation 620, a sum of music conditions M and a sum of voice conditions S may be obtained from the plurality of condition sets $\{D_i^M\}$ and $\{D_i^S\}$ that are calculated by using the music probability Pm and the speech probability Ps. In other words, the sum of music conditions M and the sum of speech conditions S may be expressed as shown in Equation 9 below.

$$M = \sum_i D_i^M \quad \text{[Equation 9]}$$

$$S = \sum_i D_i^S$$

In an operation 630, the sum of music conditions M is compared to a designated threshold value Tm. If the sum of music conditions M is greater than the threshold value Tm, an encoding mode of a current frame is switched to a music mode, that is, the spectrum domain encoding mode. If the sum of music conditions M is smaller than or equal to the threshold value Tm, the encoding mode of the current frame is not changed.

In an operation 640, the sum of speech conditions S is compared to a designated threshold value Ts. If the sum of speech conditions S is greater than the threshold value Ts, an encoding mode of a current frame is switched to a speech mode, that is, the linear prediction domain encoding mode. If the sum of speech conditions S is smaller than or equal to the threshold value Ts, the encoding mode of the current frame is not changed.

The threshold value Tm and the threshold value Ts may be set to values obtained via experiments or simulations in advance.

Figure 5:
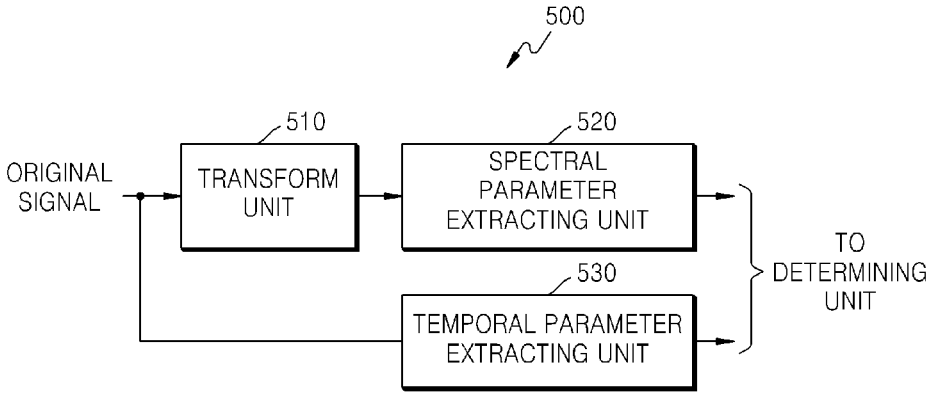
FIG. 5 is a block diagram illustrating a configuration of a feature parameter extracting unit according to an exemplary embodiment.

FIG. 5 is a block diagram illustrating a configuration of a feature parameter extracting unit 500 according to an exemplary embodiment.

An initial encoding mode determining unit 500 shown in FIG. 5 may include a transform unit 510, a spectral parameter extracting unit 520, a temporal parameter extracting unit 530, and a determining unit 540.

In FIG. 5, the transform unit 510 may transform an original audio signal from the time domain to the frequency domain. Here, the transform unit 510 may apply any of various transform techniques for representing an audio signal from a time domain to a spectrum domain. Examples of the techniques may include fast Fourier transform (FFT), discrete cosine transform (DCT), or modified discrete cosine transform (MDCT), but are not limited thereto.

The spectral parameter extracting unit 520 may extract at least one spectral parameter from a frequency domain audio signal provided by the transform unit 510. Spectral parameters may be categorized into short-term feature parameters and long-term feature parameters. The short-term feature parameters may be obtained from a current frame, whereas the long-term feature parameters may be obtained from a plurality of frames including the current frame and at least one previous frame.

The temporal parameter extracting unit 530 may extract at least one temporal parameter from a time domain audio signal. Temporal parameters may also be categorized into short-term feature parameters and long-term feature parameters. The short-term feature parameters may be obtained from a current frame, whereas the long-term feature parameters may be obtained from a plurality of frames including the current frame and at least one previous frame.

A determining unit (430 of FIG. 4) may determine the type of an audio signal by using spectral parameters provided by the spectral parameter extracting unit 520 and temporal parameters provided by the temporal parameter extracting unit 530 and may determine the initial encoding mode based on the determined type. The determining unit (430 of FIG. 4) may employ soft decision mechanism.

Figure 7:
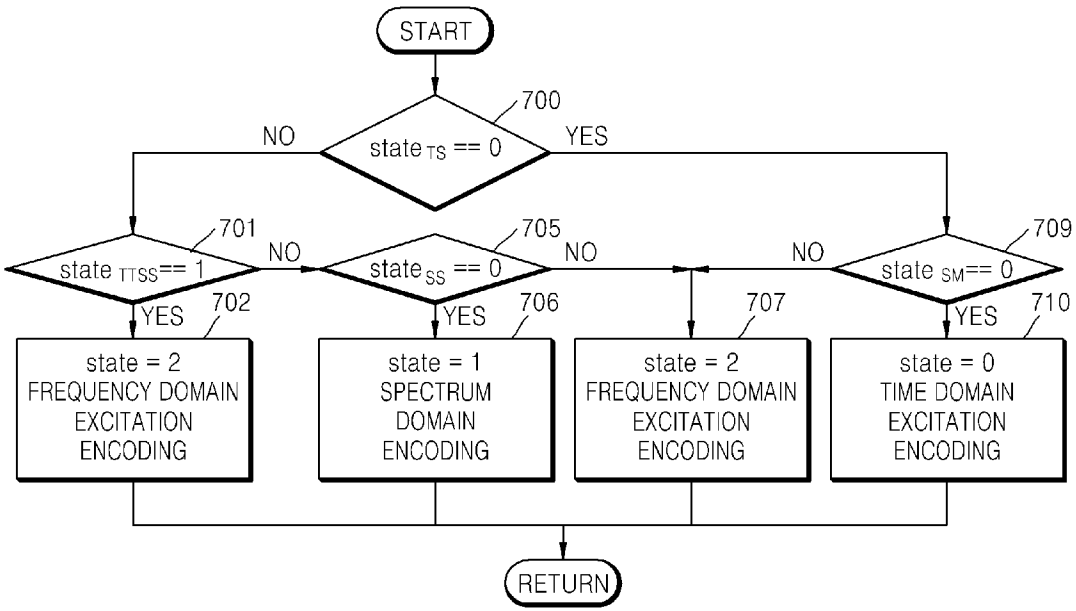
FIG. 7 is a diagram illustrating an operation of an encoding mode modifying unit according to an exemplary embodiment.

FIG. 7 is a diagram illustrating an operation of an encoding mode modifying unit 310 according to an exemplary embodiment.

Referring to FIG. 7, in an operation 700, an initial encoding mode determined by the initial encoding mode determining unit 310 is received and it may be determined whether the encoding mode is the time domain mode, that is, the time domain excitation mode or the spectrum domain mode.

In an operation 701, if it is determined in the operation 700 that the initial encoding mode is the spectrum domain mode ($state_{TS}$==1), an index $state_{TTSS}$ indicating whether the frequency domain excitation encoding is more appropriate may be checked. The index $state_{TTSS}$ indicating whether the frequency domain excitation encoding (e.g., GSC) is more appropriate may be obtained by using tonalities of different frequency bands. Detailed descriptions thereof will be given below.

Tonality of a low band signal may be obtained as a ratio between a sum of a plurality of spectrum coefficients having small values including the smallest value and the spectrum coefficient having the largest value with respect to a given band. If given bands are 0~1 kHz, 1~2 kHz, and 2~4 kHz, tonalities $t_{01}$, $t_{12}$, and $t_{24}$ of the respective bands and tonality $t_L$ of a low band signal, that is, the core band may be expressed as shown in Equation 10 below.

$$t_{01} = 0.2\log10\left(\frac{\max(x_i)}{\sum_{j=0}^{M-1}\text{sort}(x_j)}\right),\ i,\ j \in [0, \ldots, 1\ \text{kHz}] \quad \text{[Equation 10]}$$

$$t_{12} = 0.2\log10\left(\frac{\max(x_i)}{\sum_{j=0}^{M-1}\text{sort}(x_j)}\right),\ i,\ j \in [1, \ldots, 2\ \text{kHz}]$$

$$t_{24} = 0.2\log10\left(\frac{\max(x_i)}{\sum_{j=0}^{M-1}\text{sort}(x_j)}\right),\ i,\ j \in [2, \ldots, 4\ \text{kHz}]$$

$$t_L = \max(t_{01}, t_{12}, t_{24})$$

Meanwhile, the linear prediction error err may be obtained by using a linear prediction coding (LPC) filter and may be used to remove strong tonal components. In other words, the spectrum domain encoding mode may be more efficient with respect to strong tonal components than the frequency domain excitation encoding mode.

A front condition $cond_{front}$ for switching to the frequency domain excitation encoding mode by using the tonalities and the linear prediction error obtained as described above may be expressed as shown in Equation 11 below.

$$cond_{front}=t_{12}>t_{12front} \text{ and } t_{24}>t_{24front} \text{ and } t_L>t_{Lfront} \text{ and } err>err_{front} \quad \text{[Equation 11]}$$

Here, $t_{12front}$, $t_{24front}$, $t_{Lfront}$, and $err_{front}$ are threshold values and may have values obtained via experiments or simulations in advance.

Meanwhile, a back condition $cond_{back}$ for finishing the frequency domain excitation encoding mode by using the tonalities and the linear prediction error obtained as described above may be expressed as shown in Equation 12 below.

$$cond_{back}=t_{12}<t_{12back} \text{ and } t_{24}<t_{24back} \text{ and } t_L<t_{Lback} \quad \text{[Equation 12]}$$

Here, $t_{12back}$, $t_{24back}$, $t_{Lback}$ are threshold values and may have values obtained via experiments or simulations in advance.

In other words, it may be determined whether the index $state_{TTSS}$ indicating whether the frequency domain excitation encoding (e.g., GSC) is more appropriate than the spectrum domain encoding is 1 by determining whether the front condition shown in Equation 11 is satisfied or the back condition shown in Equation 12 is not satisfied. Here, the determination of the back condition shown in Equation 12 may be optional.

In an operation 702, if the index $state_{TTSS}$ is 1, the frequency domain excitation encoding mode may be determined as the final encoding mode. In this case, the spectrum domain encoding mode, which is the initial encoding mode, is modified to the frequency domain excitation encoding mode, which is the final encoding mode.

In an operation 705, if it is determined in the operation 701 that the index $state_{TTSS}$ is 0, an index $state_{SS}$ for determining whether an audio signal includes a strong speech characteristic may be checked. If there is an error in the determination of the spectrum domain encoding mode, the frequency domain excitation encoding mode may be more efficient than the spectrum domain encoding mode. The index $state_{SS}$ for determining whether an audio signal includes a strong speech characteristic may be obtained by using a difference vc between a voicing parameter and a correlation parameter.

A front condition $cond_{front}$ for switching to a strong speech mode by using the difference vc between a voicing parameter and a correlation parameter may be expressed as shown in Equation 13 below.

$$cond_{front}=vc>vc_{front} \quad \text{[Equation 13]}$$

Here, $vc_{front}$ is a threshold value and may have a value obtained via experiments or simulations in advance.

Meanwhile, a back condition $cond_{back}$ for finishing the strong speech mode by using the difference vc between a voicing parameter and a correlation parameter may be expressed as shown in Equation 14 below.

$$cond_{back}=vc<vc_{back} \quad \text{[Equation 14]}$$

Here, $vc_{back}$ is a threshold value and may have a value obtained via experiments or simulations in advance.

In other words, in an operation 705, it may be determined whether the index $state_{SS}$ indicating whether the frequency domain excitation encoding (e.g. GSC) is more appropriate than the spectrum domain encoding is 1 by determining whether the front condition shown in Equation 13 is satisfied or the back condition shown in Equation 14 is not satisfied. Here, the determination of the back condition shown in Equation 14 may be optional.

In an operation 706, if it is determined in the operation 705 that the index $state_{SS}$ is 0, i.e. the audio signal does not include a strong speech characteristic, the spectrum domain encoding mode may be determined as the final encoding mode. In this case, the spectrum domain encoding mode, which is the initial encoding mode, is maintained as the final encoding mode.

In an operation 707, if it is determined in the operation 705 that the index $state_{SS}$ is 1, i.e. the audio signal includes a strong speech characteristic, the frequency domain excitation encoding mode may be determined as the final encoding mode. In this case, the spectrum domain encoding mode, which is the initial encoding mode, is modified to the frequency domain excitation encoding mode, which is the final encoding mode.

By performing the operations 700, 701, and 705, an error in the determination of the spectrum domain encoding mode as the initial encoding mode may be corrected. In detail, the spectrum domain encoding mode, which is the initial encoding mode, may be maintained or switched to the frequency domain excitation encoding mode as the final encoding mode.

Meanwhile, if it is determined in the operation 700 that the initial encoding mode is the linear prediction domain encoding mode ($state_{TS}$==0), an index $state_{SM}$ for determining whether an audio signal includes a strong music characteristic may be checked. If there is an error in the determination of the linear prediction domain encoding mode, that is, the time domain excitation encoding mode, the frequency domain excitation encoding mode may be more efficient than the time domain excitation encoding mode. The $state_{SM}$ for determining whether an audio signal includes a strong music characteristic may be obtained by using a value 1-vc obtained by subtracting the difference vc between a voicing parameter and a correlation parameter from 1.

A front condition $cond_{front}$ for switching to a strong music mode by using the value 1-vc obtained by subtracting the difference vc between a voicing parameter and a correlation parameter from 1 may be expressed as shown in Equation 15 below.

$$cond_{front}=1-vc>vcm_{front} \quad \text{[Equation 15]}$$

Here, $vcm_{front}$ is a threshold value and may have a value obtained via experiments or simulations in advance.

Meanwhile, a back condition $cond_{back}$ for finishing the strong music mode by using the value 1-vc obtained by subtracting the difference vc between a voicing parameter and a correlation parameter from 1 may be expressed as shown in Equation 16 below.

$$cond_{back}=1-vc<vcm_{back} \quad \text{[Equation 16]}$$

Here, $vcm_{back}$ is a threshold value and may have a value obtained via experiments or simulations in advance.

In other words, in an operation 709, it may be determined whether the index $state_{SM}$ indicating whether the frequency domain excitation encoding (e.g. GSC) is more appropriate than the time domain excitation encoding is 1 by determining whether the front condition shown in Equation 15 is satisfied or the back condition shown in Equation 16 is not satisfied. Here, the determination of the back condition shown in Equation 16 may be optional.

In an operation 710, if it is determined in the operation 709 that the index $state_{SM}$ is 0 i.e. the audio signal does not include a strong music characteristic, the time domain excitation encoding mode may be determined as the final encoding mode. In this case, the linear prediction domain encoding mode, which is the initial encoding mode, is switched to the time domain excitation encoding mode as the final encoding mode. According to an exemplary embodiment, it may be considered that the initial encoding mode is maintained without modification, if the linear prediction domain encoding mode corresponds to the time domain excitation encoding mode.

In an operation 707, if it is determined in the operation 709 that the index $state_{SM}$ is 1 i.e. the audio signal includes a strong music characteristic, the frequency domain excitation encoding mode may be determined as the final encoding mode. In this case, the linear prediction domain encoding mode, which is the initial encoding mode, is modified to the frequency domain excitation encoding mode, which is the final encoding mode.

By performing the operations 700 and 709, an error in the determination of the initial encoding mode may be corrected. In detail, the linear prediction domain encoding mode (e.g., the time domain excitation encoding mode), which is the initial encoding mode, may be maintained or switched to the frequency domain excitation encoding mode as the final encoding mode.

According to an exemplary embodiment, the operation 709 for determining whether the audio signal includes a strong music characteristic for correcting an error in the determination of the linear prediction domain encoding mode may be optional.

According to another exemplary embodiment, a sequence of performing the operation 705 for determining whether the audio signal includes a strong speech characteristic and the operation 701 for determining whether the frequency domain excitation encoding mode is appropriate may be reversed. In other words, after the operation 700, the operation 705 may be performed first, and then the operation 701 may be performed. In this case, parameters used for the determinations may be changed as occasions demand.

Figure 8:
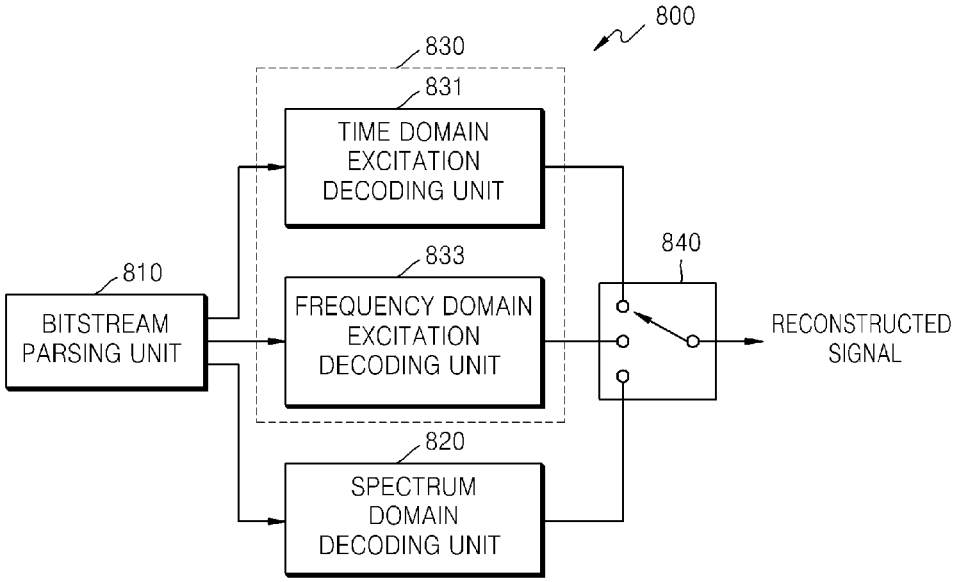
FIG. 8 is a block diagram illustrating a configuration of an audio decoding apparatus according to an exemplary embodiment.

FIG. 8 is a block diagram illustrating a configuration of an audio decoding apparatus 800 according to an exemplary embodiment.

The audio decoding apparatus 800 shown in FIG. 8 may include a bitstream parsing unit 810, a spectrum domain decoding unit 820, a linear prediction domain decoding unit 830, and a switching unit 840. The linear prediction domain decoding unit 830 may include a time domain excitation decoding unit 831 and a frequency domain excitation decoding unit 833, where the linear prediction domain decoding unit 830 may be embodied as at least one of the time domain excitation decoding unit 831 and the frequency domain excitation decoding unit 833. Unless it is necessary to be embodied as a separate hardware, the above-stated components may be integrated into at least one module and may be implemented as at least one processor (not shown).

Referring to FIG. 8, the bitstream parsing unit 810 may parse a received bitstream and separate information on an encoding mode and encoded data. The encoding mode may correspond to either an initial encoding mode obtained by determining one from among a plurality of encoding modes including a first encoding mode and a second encoding mode in correspondence to characteristics of an audio signal or a third encoding mode modified from the initial encoding mode if there is an error in the determination of the initial encoding mode.

The spectrum domain decoding unit 820 may decode data encoded in the spectrum domain from the separated encoded data.

The linear prediction domain decoding unit 830 may decode data encoded in the linear prediction domain from the separated encoded data. If the linear prediction domain decoding unit 830 includes the time domain excitation decoding unit 831 and the frequency domain excitation decoding unit 833, the linear prediction domain decoding unit 830 may perform time domain excitation decoding or frequency domain exciding decoding with respect to the separated encoded data.

The switching unit 840 may switch either a signal reconstructed by the spectrum domain decoding unit 820 or a signal reconstructed by the linear prediction domain decoding unit 830 and may provide the switched signal as a final reconstructed signal.

Figure 9:
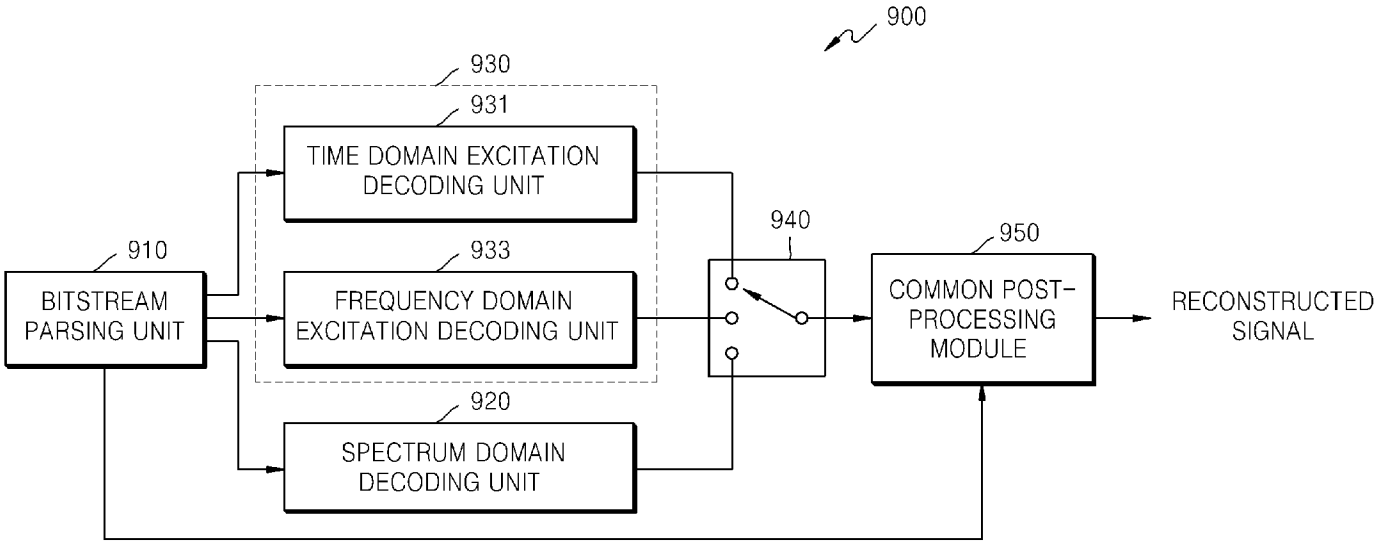
FIG. 9 is a block diagram illustrating a configuration of an audio decoding apparatus according to another exemplary embodiment.

FIG. 9 is a block diagram illustrating a configuration of an audio decoding apparatus 900 according to another exemplary embodiment.

The audio decoding apparatus 900 may include a bitstream parsing unit 910, a spectrum domain decoding unit 920, a linear prediction domain decoding unit 930, a switching unit 940, and a common post-processing module 950. The linear prediction domain decoding unit 930 may include a time domain excitation decoding unit 931 and a frequency domain excitation decoding unit 933, where the linear prediction domain decoding unit 930 may be embodied as at least one of time domain excitation decoding unit 931 and the frequency domain excitation decoding unit 933. Unless it is necessary to be embodied as a separate hardware, the above-stated components may be integrated into at least one module and may be implemented as at least one processor (not shown). Compared to the audio decoding apparatus 800 shown in FIG. 8, the audio decoding apparatus 900 may further include the common post-processing module 950, and thus descriptions of components identical to those of the audio decoding apparatus 800 will be omitted.

Referring to FIG. 9, the common post-processing module 950 may perform joint stereo processing, surround processing, and/or bandwidth extension processing, in correspondence to a common pre-processing module (205 of FIG. 2).

The methods according to the exemplary embodiments can be written as computer-executable programs and can be implemented in general-use digital computers that execute the programs by using a non-transitory computer-readable recording medium. In addition, data structures, program instructions, or data files, which can be used in the embodiments, can be recorded on a non-transitory computer-readable recording medium in various ways. The non-transitory computer-readable recording medium is any data storage device that can store data which can be thereafter read by a computer system. Examples of the non-transitory computer-readable recording medium include magnetic storage media, such as hard disks, floppy disks, and magnetic tapes, optical recording media, such as CD-ROMs and DVDs, magneto-optical media, such as optical disks, and hardware devices, such as ROM, RAM, and flash memory, specially configured to store and execute program instructions. In addition, the non-transitory computer-readable recording medium may be a transmission medium for transmitting signal designating program instructions, data structures, or the like. Examples of the program instructions may include not only mechanical language codes created by a compiler but also high-level language codes executable by a computer using an interpreter or the like.

While exemplary embodiments have been particularly shown and described above, it will be understood by those of ordinary skill in the art that various changes in form and details may be made therein without departing from the spirit and scope of the inventive concept as defined by the appended claims. The exemplary embodiments should be considered in descriptive sense only and not for purposes of limitation. Therefore, the scope of the inventive concept is defined not by the detailed description of the exemplary embodiments but by the appended claims, and all differences within the scope will be construed as being included in the present inventive concept.

What is claimed is:

1. A method of encoding an audio signal, the method comprising:

receiving the audio signal;

obtaining, performed by at least one processor, first parameters of a current frame of the audio signal;

selecting, performed by the at least one processor, a class of the current frame of the audio signal from among a plurality of classes including a music class and a speech class, based on the first parameters of the current frame;

obtaining second parameters including first tonality, second tonality and third tonality;

determining, performed by the at least one processor, whether to change the selected class of the current frame based on the obtained second parameters and a hangover parameter;

when it is determined to change the selected class of the current frame, changing, performed by the at least one processor, the selected class of the current frame to another class;

encoding, performed by the at least one processor, the current frame, based on either the selected class or the another class of the current frame; and generating a bitstream based on the encoded current frame, wherein the first tonality is obtained from a subband of 0 to 1 kHz, the second tonality is obtained from a subband of 1 to 2 kHz and the third tonality is obtained from a subband of 2 to 4 kHz.

2. The method of claim 1, wherein the changing is performed based on at least two independent states.

3. The method of claim 1, wherein the second parameters further include a difference between a voicing parameter and a correlation parameter.

4. The method of claim 1, wherein the determining of whether to change the selected class of the current frame comprises:

determining whether the current frame has speech characteristics when the current frame is classified as the music class; and determining whether the current frame has music characteristics when the current frame is classified as the speech class.

5. The method of claim 1, wherein the changing comprises:

changing a classification of the current frame, when the current frame is classified as the music class and has speech characteristics; and changing the classification of the current frame, when the current frame is classified as the speech class and has music characteristics.

* * * * *